US012011754B2

(12) United States Patent
Garnier

(10) Patent No.: US 12,011,754 B2
(45) Date of Patent: Jun. 18, 2024

(54) METHOD AND A DEVICE FOR MANUFACTURING A PART STARTING FROM A CUSHION MADE OF DEFORMABLE MATERIAL, IN PARTICULAR FOR AN EDGE OF AN ELEMENT OF AN AIRCRAFT

(71) Applicant: Airbus Operations (S.A.S.), Toulouse (FR)

(72) Inventor: César Garnier, Toulouse (FR)

(73) Assignee: Airbus Operations (S.A.S.), Toulouse (FR)

( * ) Notice: Subject to any disclaimer, the term of this patent is extended or adjusted under 35 U.S.C. 154(b) by 0 days.

(21) Appl. No.: 17/871,482

(22) Filed: Jul. 22, 2022

(65) Prior Publication Data

US 2023/0065876 A1 Mar. 2, 2023

(30) Foreign Application Priority Data

Aug. 5, 2021 (FR) ..... 2108538

(51) Int. Cl.
*B21D 26/021* (2011.01)
*B21D 53/92* (2006.01)

(52) U.S. Cl.
CPC ..... *B21D 26/021* (2013.01); *B21D 53/92* (2013.01)

(58) Field of Classification Search
CPC .... B21D 26/021; B21D 53/92; B21D 26/059; B21D 53/18; B21D 26/031; B21D 22/12; B21D 53/045
See application file for complete search history.

(56) References Cited

U.S. PATENT DOCUMENTS 2,582,358 A * 1/1952 Schoellerman ..... B21D 53/045 29/890.039
3,807,009 A * 4/1974 Ostbo ..... B21D 26/059 29/411

(Continued)

FOREIGN PATENT DOCUMENTS

CN 113 020 391 A 6/2021
DE 10023078 A1 * 11/2001 ..... B21D 26/021

(Continued)

OTHER PUBLICATIONS

Matthies; DE-10023078-A1 Machine Translation (Year: 2001).*

(Continued)

*Primary Examiner* — Lee A Holly
(74) *Attorney, Agent, or Firm* — KDW Firm PLLC

(57) ABSTRACT

A method and a device for manufacturing a part starting from a cushion made of deformable material, in particular for an edge of an element of an aircraft. The device includes a preparation unit to create a cushion with two plates and, between the plates, an internal space with an opening, and a molding unit comprising a mold in which the cushion is positioned, the mold comprising two shells and an imprint corresponding to the shape of the part to be manufactured, the molding unit configured to inject a pressurized fluid into the internal space of the cushion through the opening to deform the cushion such that it matches the imprint and forms the part, the device being capable of manufacturing one-piece parts of various sizes, and in particular parts having complex shapes, in particular non-developable shapes.

8 Claims, 5 Drawing Sheets

(56) References Cited

U.S. PATENT DOCUMENTS

| | | | | |
|---|---|---|---|---|
| 5,932,167 | A * | 8/1999 | Fritz | B21D 22/12 425/387.1 |
| 2002/0166222 | A1* | 11/2002 | Kojima | B21D 26/021 72/60 |
| 2007/0084538 | A1 | 4/2007 | Nakazawa et al. | |

FOREIGN PATENT DOCUMENTS

| | | | |
|---|---|---|---|
| EP | 0581458 | A2 | 2/1994 |
| EP | 1 256 397 | A | 11/2002 |
| EP | 1 306 145 | A1 | 5/2003 |
| EP | 3 485 996 | A1 | 5/2019 |
| FR | 2 132 483 | A1 | 11/1972 |
| FR | 2 975 929 | A1 | 12/2012 |
| KR | 2020 0127319 | A | 11/2020 |

OTHER PUBLICATIONS

Matthies H, DE-10023078-A1 Machine Translation (Year: 2001).*
European Search Report for U.S. Appl. No. 22/184,523 dated Jul. 22, 2022.
European Search Report for U.S. Appl. No. 22/184,524 dated Jul. 22, 2022.
French Search Report for Application No. 2108531 dated Mar. 31, 2022.
French Search Report for Application No. 2108538 dated Apr. 4, 2022.

* cited by examiner

METHOD AND A DEVICE FOR MANUFACTURING A PART STARTING FROM A CUSHION MADE OF DEFORMABLE MATERIAL, IN PARTICULAR FOR AN EDGE OF AN ELEMENT OF AN AIRCRAFT

CROSS-REFERENCE TO RELATED APPLICATION

This application claims priority to French patent application number 2108538 filed on Aug. 5, 2021, the entire disclosure of which is incorporated by reference herein.

TECHNICAL FIELD

The disclosure herein relates to a method and a device for manufacturing parts made of deformable material, in particular for an edge of an element of an aircraft.

BACKGROUND

The disclosure herein relates in particular—but not exclusively—to the manufacture of a part intended for any type of edge, in particular a leading edge, of an element in particular of an aircraft, and in particular of a transport airplane. It may in particular be an aerodynamic element, that is to say an element whose shape serves to optimize the airflow over its surface, such as an air intake or a wing.

Generally, parts of this kind are made of an aluminum alloy, using manufacturing methods that make use of plastic deformation. These parts may have complex shapes, for example non-developable shapes, which makes them difficult to manufacture with conventional methods. In particular, this requires specialized tools and multiple successive steps, including heat treatments. The manufacture of such parts is therefore lengthy and costly.

Furthermore, there is currently significant inconsistency in the methods for manufacturing this type of part, which can result in differences in the mechanical properties of the parts. In particular, the parts are not always one-piece, but are often created by assembling multiple elements, which implies lengthy and costly manufacture.

Furthermore, it is not possible, using conventional manufacturing methods, to create this type of part using a variety of materials, in particular titanium which is highly desired in the field of aeronautics.

There is therefore a need to have a solution with which a one-piece part made of deformable material can be manufactured rapidly and at low cost, and moreover in a variety of materials, in particular titanium.

SUMMARY

The aim of the disclosure herein is to meet this need. To that end, it relates to a method for manufacturing at least one part made of deformable material, in particular for an edge of an element of an aircraft.

According to the disclosure herein, the method involves at least the following steps:

- a preparation step that consists in or comprises creating a cushion provided with two plates arranged against one another so as to create an internal space and comprising at least one opening that allows access to this internal space;
- a molding step that consists in or comprises positioning the cushion at least partially in a mold, the mold comprising at least two shells and an imprint corresponding to the shape of the part that is to be manufactured, closing the mold by joining the shells to one another, and injecting a pressurized fluid into the internal space of the cushion through the opening so as to deform the cushion in order that it matches the imprint of the mold and forms a rough part that has the shape of the part that is to be manufactured; and
- a finishing step that consists in or comprises demolding the rough part and carrying out finishing operations on the rough part in order to obtain the manufactured part.

Thus, the stated method, comprising molding by injection of pressurized fluid, provides a method for manufacture by plastic deformation, by which it is possible to create one piece parts of varied sizes and made of a variety of materials (in particular titanium), and in particular parts whose shapes are complex such as non-developable shapes.

Advantageously, in the preparation step, the plates of the cushion are arranged by securing the plates to one another by welding at their peripheral ends.

In a preferred embodiment, the molding step uses a mold whose imprint is of a shape by which it is possible to simultaneously manufacture at least two parts. The manufacture implemented by the manufacturing method can be carried out cold. However, in one particular embodiment, the molding step further comprises a heating sub-step which takes place after the mold has been closed and which consists in or comprises heating at least the cushion prior to injection of the pressurized fluid. Advantageously, the heating sub-step corresponds to one of the following sub-steps:

- placing the mold containing the cushion in an oven and heating the mold and the cushion using the oven;
- placing the cushion alone in an oven and heating the cushion prior to placing it in the mold;
- heating the cushion using the mold, the mold being of the heating type.

Moreover, in a first embodiment, the cushion is annular in shape, being provided with an end referred to as the inner end corresponding to the inner periphery of the annular shape, and an end referred to as the outer end corresponding to the outer periphery of the annular shape, and, in the molding step, at least one of the inner and outer ends of the cushion is fastened to the mold.

Moreover, in a second embodiment, the cushion is annular in shape, being provided with an end referred to as the inner end corresponding to the inner periphery of the annular shape, and an end referred to as the outer end corresponding to the outer periphery of the annular shape, and, in the molding step, the inner and outer ends of the cushion are mounted so as to move freely relative to the mold.

The disclosure herein also relates to a device for manufacturing at least one part made of deformable material, in particular for an edge of an element of an aircraft.

According to the disclosure herein, the device comprises at least:

- a preparation unit configured to create a cushion provided with two plates arranged against one another so as to create an internal space and comprising at least one opening that allows access to this internal space; and
- a molding unit comprising a mold in which it is possible to position at least part of the cushion, the mold comprising at least two shells and an imprint corresponding to the shape of the part that is to be manufactured, the mold being able to be closed while joining the shells to one another, the molding unit being configured to inject a pressurized fluid into the internal space of the cushion through the opening in order to deform the cushion positioned in the mold such that it matches the imprint of the mold and forms a rough part having the shape of the part that is to be manufactured, the rough part being able to undergo finishing operations in order to form the manufactured part.

Advantageously, the mold further comprises, in addition to the imprint, at least one auxiliary space that is able to supply material to the cushion while it is being deformed by the pressurized fluid, in at least one of the following cases:

- the auxiliary space is configured to be able to contain some of the material of the cushion that is intended to supply material for the deformation of the cushion;
- the auxiliary space is configured to allow at least one end of the cushion to slide between the shells of the mold in order to supply material for the deformation of the cushion.

In one particular embodiment, the device further comprises an oven that is able to receive and heat the mold containing the cushion, or the cushion alone.

BRIEF DESCRIPTION OF THE DRAWINGS

The appended figures will make it easy to understand how the disclosure herein may be implemented. In these figures, identical references denote similar elements.

DETAILED DESCRIPTION

Figure 1:
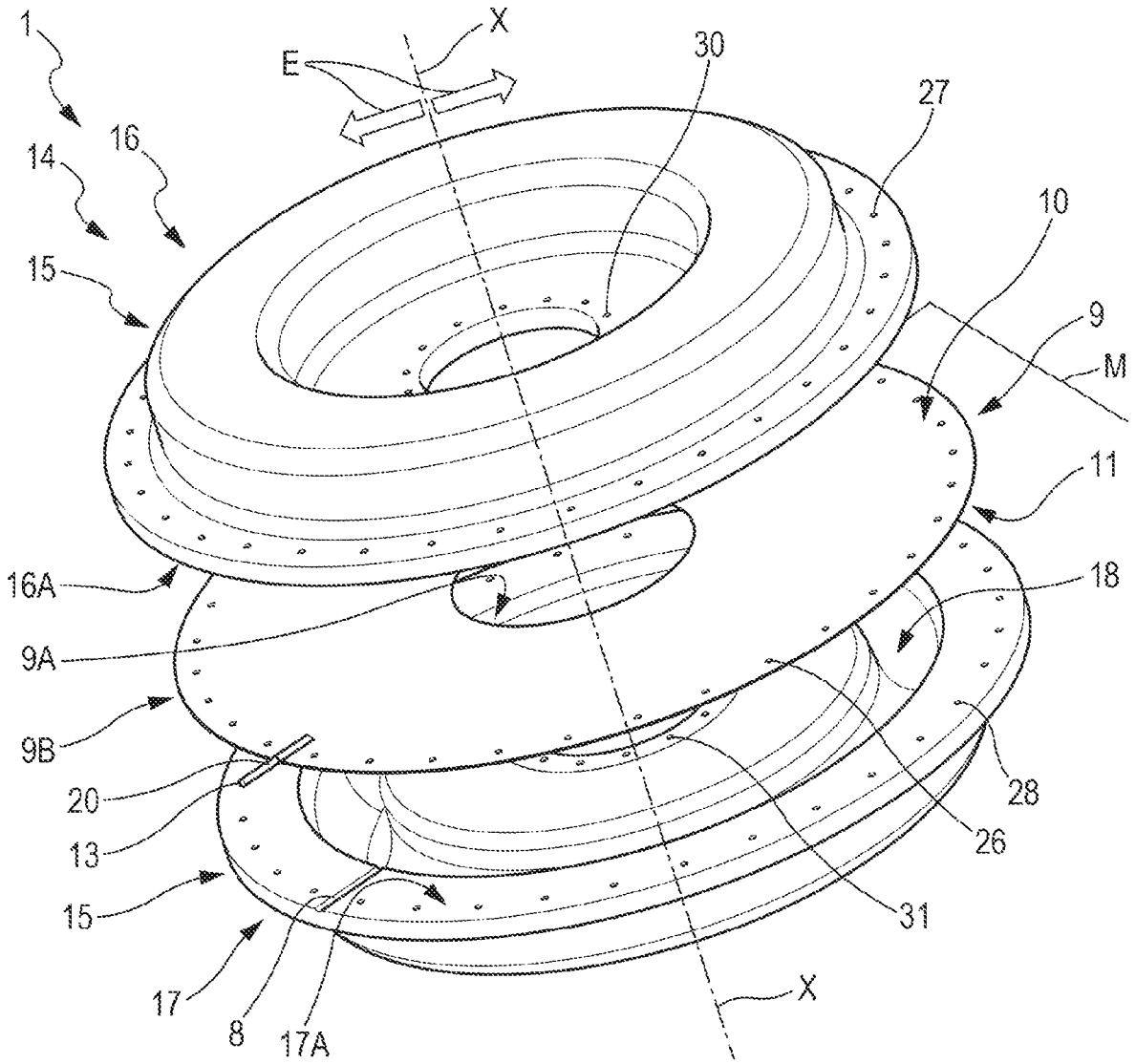
FIG. 1 is an exploded perspective view of a molding unit of a manufacturing device.
Figure 2:
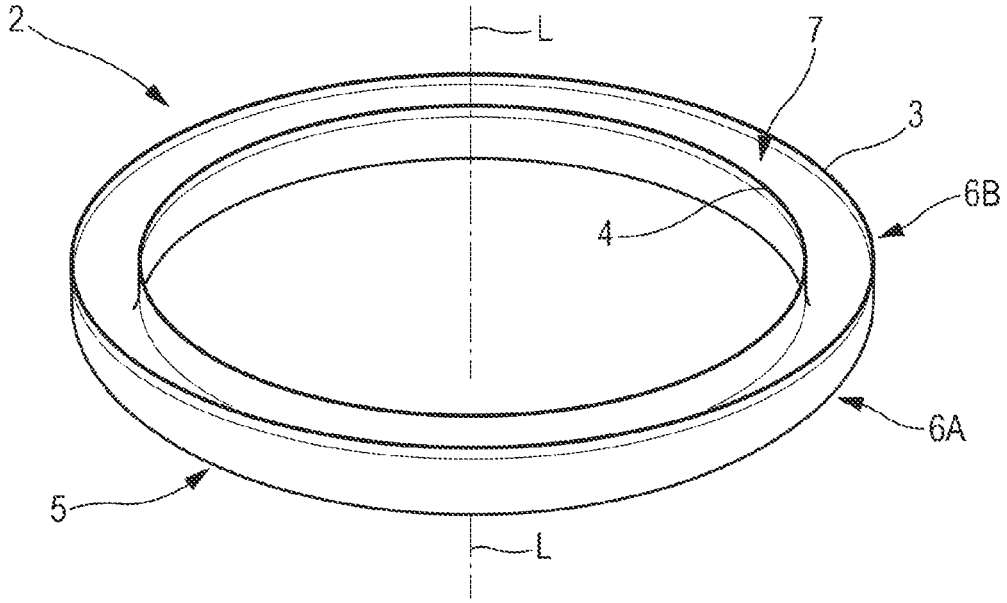
FIG. 2 is a perspective view, of a part manufactured by a manufacturing device.

The device 1, which is depicted schematically in FIG. 1 and which serves to illustrate the disclosure herein, is a device 1 manufacturing a part 2 made of deformable material, such as that depicted by way of example in FIG. 2.

In the context of the disclosure herein, the part 2 may be a part that is intended to be arranged on an element of an aircraft, in particular a transport airplane. The part 2 is in particular intended to be arranged on a leading edge of an external element of the aircraft, in particular an aerodynamic element, that is to say one that is configured to optimize the flow of air over its surface. This may for example be any aerodynamic surface of an external element of the aircraft, such as a wing, a propulsion system or a stabilizer.

In one preferred embodiment, which is depicted in FIG. 2, the part 2 has a generally annular shape, having symmetry of revolution about an axis L-L. More specifically, the part 2 has a U-shaped cross section and is provided with two cylindrical walls 3 and 4. Furthermore, the part 2 comprises, at one of the longitudinal ends 6A, a rounded base 5 that connects the walls 3 and 4, and an opening 7 at the other longitudinal end 6B.

In the following description, the term "plate" is to be understood as meaning any generally flat element provided with at least one planar surface that can serve as a bearing surface for another plate.

Figure 3:
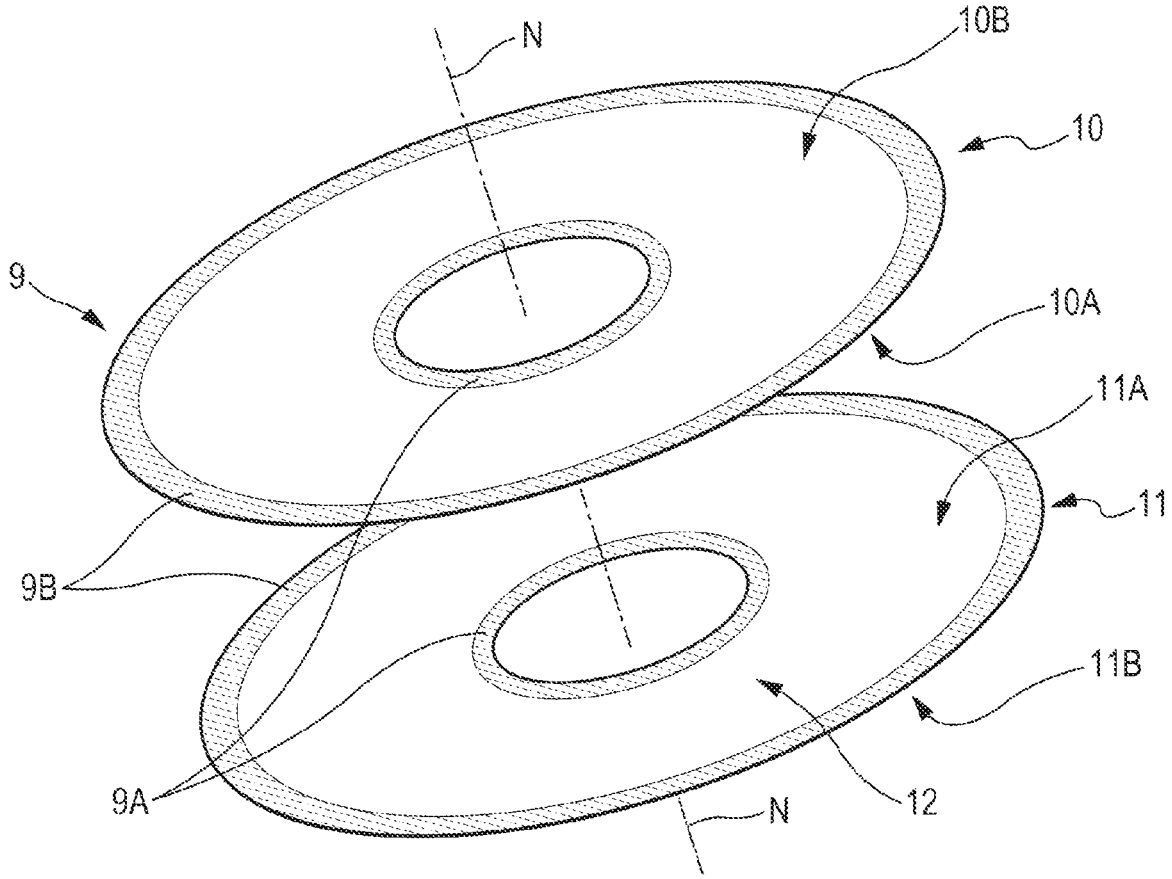
FIG. 3 is an exploded perspective view of a cushion prior to deformation during a molding step.

In order to manufacture the part 2, the device 1 comprises a preparation unit that is configured to create a cushion 9 from two plates 10 and 11. In particular, and as shown in FIG. 3, the plate 10 is provided with a face 10A referred to as the inner face, and a face 10B referred to as the outer face. Similarly, the plate 11 is provided with a face 11A referred to as the inner face, and a face 11B referred to as the outer face. The faces 10A and 11A are those faces which are intended to be arranged one against the other to form the cushion 9.

The plates 10 and 11 can be held in position, pressed against one another, in various ways. In a first embodiment, this holding in position is referred to as provisional, the plates 10 and 11 being held against one another, this being intended only for handling of the cushion 9 and does not make it possible to ensure a very strong join. In a second embodiment, this holding in position is referred to as permanent, wherein the plates 10 and 11 are held joined to one another, which serves to ensure very good cohesion of the cushion 9. For example, the plates 10 and 11 can be bolted, riveted or welded to one another.

In one preferred embodiment, which is depicted in FIG. 3, the cushion 9 has an annular shape, having symmetry of revolution about an axis N-N. The annular shape has an inner periphery, in the form of a circle coaxial with the axis N-N, which faces towards the axis N-N, and an outer periphery, also in the form of a circle coaxial with the axis N-N, which faces away from the axis N-N. The cushion 9 is provided with an end 9A referred to as the inner end, and an end 9B referred to as the outer end, these ends corresponding respectively to the inner and outer peripheries of the annular shape.

The manner in which the plates 10 and 11 are arranged, and the fact that they are connected to one another, makes it possible to create between them a space 12, referred to as the internal space, located between the faces 10A and 11A and, as the case may be, bounded by the ends 9A and 9B of the cushion 9.

Furthermore, the cushion 9 is provided with at least one opening 13, which provides access to the internal space 12. The opening 13 can be created in one of plates 10 and 11, or be created at the interface between the faces 10A and 11A of the plates 10 and 11. The opening 13 may correspond to an open space such as a hole which can be created directly in the cushion 9 or in an added element. An added element of this kind may in particular correspond, as shown in FIG. 1, to a supply tube 20 which is arranged between the plates 10 and 11 and which serves in particular to allow the opening 13 to open into the space 12 at one end of the supply tube 20, and to open to the outside of the cushion 9 at another end of the supply tube 20.

Figure 4:
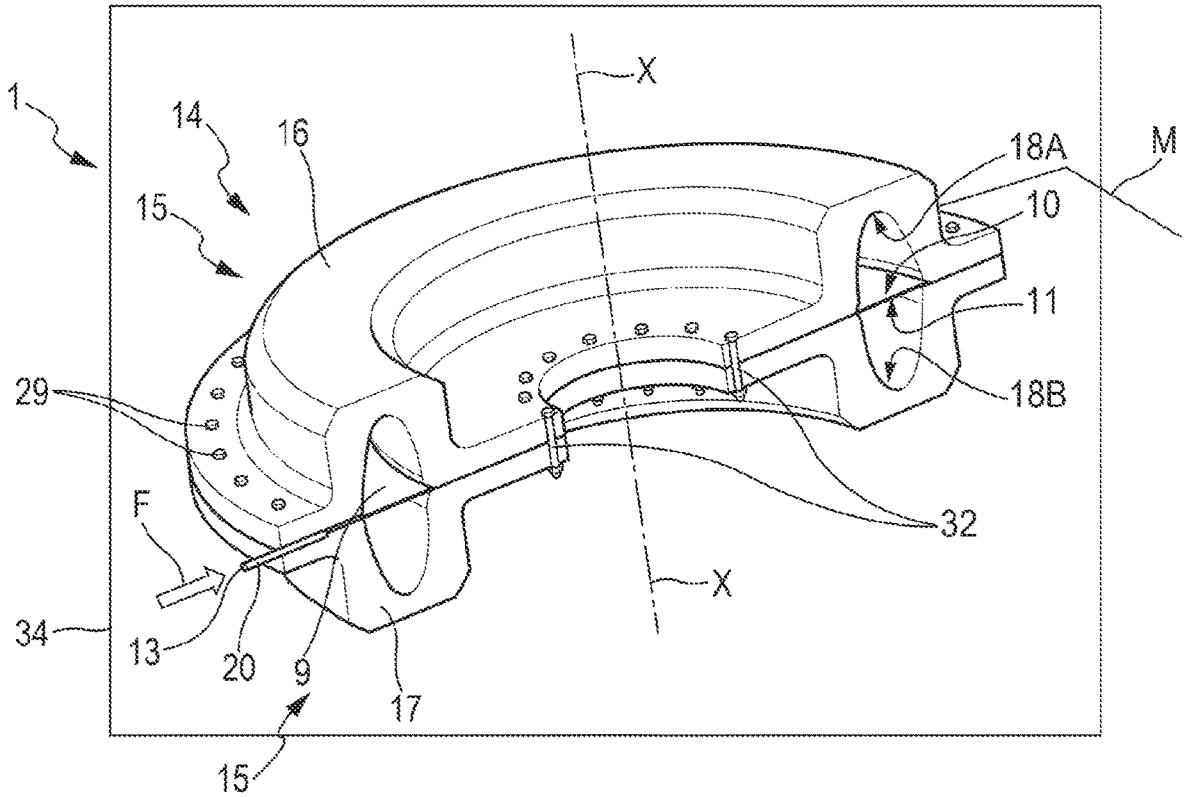
FIG. 4 is a view, in section and in perspective, of a molding unit comprising a non-deformed cushion in a closed mold.
Figure 5:
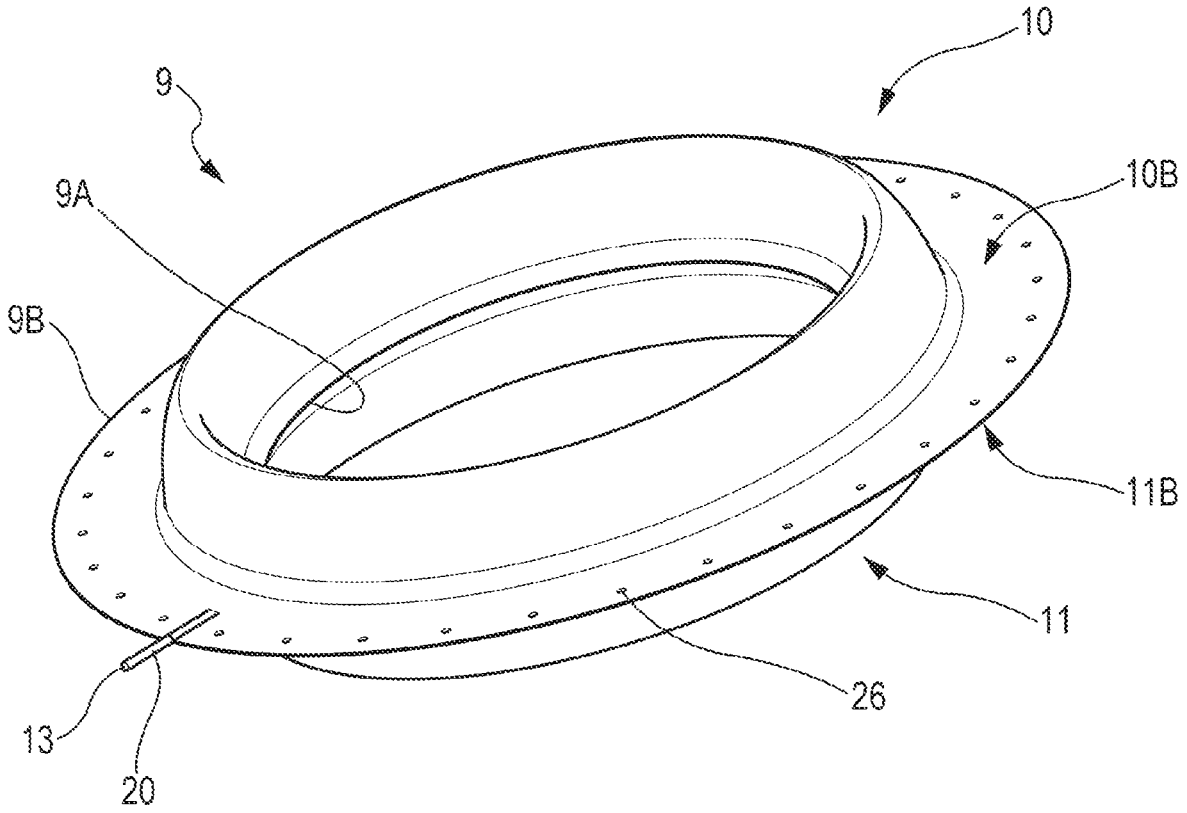
FIG. 5 is a perspective view of a cushion after deformation during a molding step.

In order to manufacture the part 2, the device 1 comprises a molding unit 14 that comprises a mold 15 provided with at least two shells 16 and 17, as in the example of FIGS. 1 and 4. The cushion 9 is intended to be positioned inside of the mold 15, specifically between the shells 16 and 17. Depending on the complexity of the shapes of the part 2 that is to be manufactured, the mold 15 may comprise more than two shells.

In one preferred embodiment, as depicted in FIGS. 1 and 4, the mold 15 has a longitudinal axis X-X. Furthermore, the shells 16 and 17 have symmetry of revolution about this longitudinal axis X-X.

Moreover, the mold 15 comprises an imprint 18 having the shape of the part 2 that is to be manufactured. The imprint 18 corresponds to a shape cut into at least one of the shells 16 and 17, wherein the shape can be created on a so-called internal face 16A of the shell 16 or on a so-called internal face 17A of the shell 17. The imprint 18 may equally be cut into both shells 16 and 17, the imprint 18 then comprising two so-called partial cavities, specifically a partial imprint 18A in shell 16 and a partial imprint 18B in shell 17. The imprint 18 is reconstituted in its entirety when the shells are brought together, as explained hereinbelow.

In the following description:

"longitudinal" is to be understood as an element aligned along the longitudinal axis X-X or along a direction parallel to this longitudinal axis X-X;

"radially outer" and "radially towards the outside" are to be understood as directions radial to the longitudinal axis X-X, moving away from the longitudinal axis X-X, as depicted by arrows E in FIG. 1;

"radially inner" and "radially towards the inside" are to be understood as directions radial to the longitudinal axis X-X, moving towards the longitudinal axis X-X, that is to say in the opposite direction to that depicted by the arrows E in FIG. 1;

"inside of the mold 15" is to be understood as the space between the shells 16 and 17 (comprising the imprint 18) and, where relevant, the space between the faces 16A and 17A; and "outside of the mold" is to be understood as the space which is not included between the shells 16 and 17.

In the preferred embodiment shown in FIGS. 1 and 4, the imprint 18 comprises two identical partial mold cavities, specifically the partial imprint 18A in shell 16 and the partial imprint 18B in shell 17. Thus, the imprint 18 is symmetric with respect to a median plane M located between the shells 16 and 17, corresponding to a plane that is parallel to the faces 16A and 17A and is equidistant from the shells 16 and 17. In the example of FIG. 4, the median plane M is orthogonal to the longitudinal axis X-X.

Moreover, in this embodiment, the shells 16 and 17 comprise, on their faces 16A and 17A, a recess 8 that serves to receive the supply tube 20 when the cushion 9 is positioned in the mold 15. The recess 8, having the general shape of the supply tube 20, is configured in such a way that that end of the supply tube 20 which is located radially towards the outside of the cushion opens at the outside of the mold 15. Thus, the opening 13 created in the supply tube 20 provides access to the space 12 from the outside of the mold 15.

In other embodiments (not shown), the imprint 18 may comprise partial mold cavities which have different shapes or are not symmetric with respect to the median plane M. The imprint 18 may also not comprise a partial imprint on one or other of the shells 16 and 17.

The mold 15 is designed to be closed, thus bringing together the shells 16 and 17. In particular, the faces 16A and 17A of the shells 16 and 17 can be brought together longitudinally, the faces 16A and 17A being mutually parallel. Furthermore, when the shells 16 and 17 are brought together, the partial mold cavities 18A, 18B are aligned facing one another in such a way that the meeting of the shapes of the partial mold cavities 18A, 18B serves to re-form the imprint 18. To bring together the shells 16 and 17, the faces 16A and 17A may comprise positioning elements (not shown in the figures) that serve to align the shells 16 and 17 when closing the mold 15, and thus to also align the partial mold cavities 18A and 18B. These positioning elements may correspond to structural shapes that form an integral part of the shells 16 and 17, or may correspond to removable tooling elements that are installed on the shells 16 and 17 upon closing the mold 15.

The mold 15 is also designed to be able to receive the cushion 9 between the shells 16 and 17. Indeed, the faces 16A and 17A, when they are brought close to one another, are designed to clamp against the faces 10B and 11B so as to squeeze the cushion 9 between the shells 16 and 17 when the mold 15 is closed. Depending on the size of the cushion 9, it may be contained entirely inside of the mold 15, or just partially, with one or other of its ends 9A and 9B arranged outside the mold 15.

In one particular embodiment, the cushion 9 thus positioned inside of the mold 15 is designed to be able to be attached to the mold 15, at least at one of its ends 9A and 9B. In particular, the ends 9A and 9B of the cushion 9 are designed to be able to be held fixed relative to the mold 15. To that end, the ends 9A, 9B may be fastened to one or other of the shells 16, 17 using conventional fastening elements.

In one embodiment, depicted in FIGS. 1 and 4, the end 9A of the cushion 9 is mounted so as to move freely relative to the mold 15 and the end 9B is bolted to the shells 16 and 17.

In that embodiment, the cushion 9 is provided with through-holes 26 spread along its end 9B. Furthermore, the shells 16 comprises through-holes 27 and the shell 17 comprises through-holes 28, the holes 27, 28 being created in the radially outer periphery of the shells 16 and 17. Moreover, the holes 26, 27 and 28 are designed such that they can be aligned with one another when the cushion 9 is positioned in the mold 15 and the shells 16 and 17 are brought together. Thus, the end 9B of the cushion 9 can be bolted to the shells 16 and 17 using bolts 29, as shown in FIG. 4.

In another embodiment (not shown), the ends 9A or 9B of the cushion may be held fixed with respect to the mold 15 without using any fasteners, solely by the squeezing force of the shells 16 and 17 when the mold 15 is closed and locked, as set out hereinbelow.

In another embodiment (not shown), the two ends 9A and 9B of the cushion 9 are mounted so as to move freely relative to the mold 15. In this embodiment, neither of the ends 9A and 9B is securely fastened to the shells 16 and 17. Preferably, the cushion 9 is held in position in the mold 15 by the general shapes of the faces 16A and 17A and by the squeezing of the shells 16 and 17, but it is not held fixedly, which allows the ends 9A and 9B to move, in particular by sliding when the cushion 9 deforms, as described hereinbelow.

The mold 15, thus closed and containing the cushion 9, is designed to be locked so as to prevent the shells 16 and 17 from moving apart, so that they hold the cushion 9 captive. To that end, the shells 16 and 17 are securely fastened to one another, for example by being bolted together.

Moreover, the mold 15 is designed such that access to the opening 13 is possible from the outside of the mold 15 when the latter is closed and locked with the cushion 9 positioned inside.

In one particular embodiment, the opening 13 is arranged at one end 9A or 9B of the cushion 9 and is located on the outside of the mold 15 when the latter is closed. As a result, access to the opening 13 is possible from the outside of the mold 15 when the latter is closed.

In one particular embodiment, shown in FIGS. 1 and 4, the opening 13 of the cushion 9 is created through the supply tube 20 which is arranged between the plates 10 and 11. More specifically, the supply tube 20 is located in the plane of interface of the plates 10 and 11 and is oriented radially with respect to the axis X-X. Furthermore, the module 15 is configured to receive the supply tube 20 in the recess 8 such that one end of the supply tube 20 projects radially out from the mold 15 when the latter is closed and contains the cushion 9. Since the opening 13 is created between the two ends of the supply tube 20, it is therefore accessible from the outside of the mold 15 when the latter is closed.

In the embodiment shown in FIGS. 1 and 4, in addition to the holes 27, 28 at their radially outer ends, the shells 16 and 17 respectively comprise through-holes 30 and 31 at their radially inner ends. The holes 30, 31 are configured in such a way that they can be aligned with one another when the shells 16 and 17 are brought together. The holes 27, 28, 30 and 31 make it possible to bolt the shells 16 and 17 together in order to lock the mold 15. The shells 16 and 17 are bolted at their outer ends by the bolts 29, and at their inner ends by the bolts 32.

In one particular embodiment, the bolts 29 and 32 which serve to lock the mold 15 also make it possible to fasten one or other of the ends 9A and 9B of the cushion 9, depending on whether or not the ends 9A and 9B are fixed with respect to the mold 15.

In another embodiment (not shown), the mold 15 may be locked by a pressing tool of the mechanical or hydraulic press type, generating on the shells 16 and 17 opposite longitudinal forces that are oriented towards the inside of the mold 15.

Moreover, the molding unit 14 comprises structure (not shown in the figures) for injecting a pressurized fluid, as shown by an arrow F in FIG. 4, into the internal space 12 of the cushion 9. The fluid is injected through the opening 13 into the internal space 12, resulting in deformation of the cushion 9. In particular, the injection means are designed to inject the fluid under very high pressure such that the pressure generated in the internal space 12 is able to deform the walls of the cushion 9 in order that they match the shape of the imprint 18. The cushion 9 thus deformed becomes a rough part.

Moreover, the device 1 comprises finishing device(s)/structure(s) (not shown in the figures) that can be used to carry out finishing operations on the rough part in order to obtain a finished or semi-finished part. Indeed, the part obtained after the finishing operations can correspond directly to the part 2 or to an intermediate part requiring additional operations.

The finishing operations correspond to the normal completion operations of a molding method and consist in removing unwanted shapes and excess material from the rough part. They may also involve rectifying certain surfaces.

In one particular embodiment, the molding unit 14 is designed to create a rough part having a general shape with at least one particular symmetry, which makes it possible to manufacture, starting from the rough part, at least two parts 2, as explained in the example hereinbelow.

Figure 6:
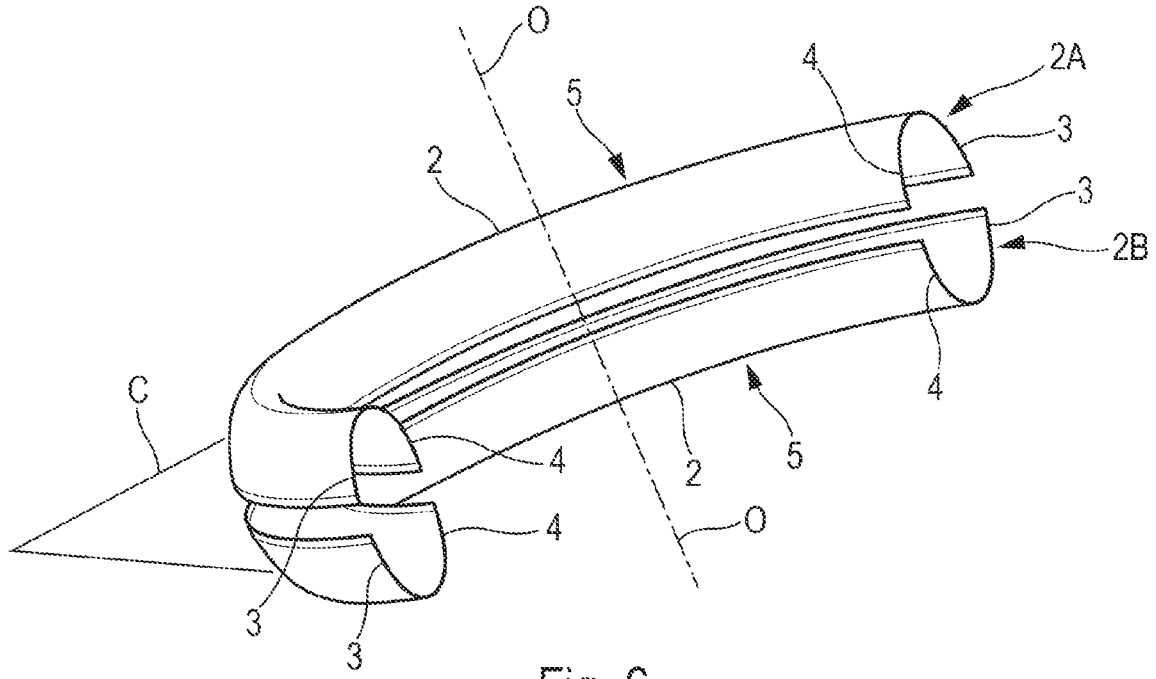
FIG. 6 is a partial perspective and cutaway view of two parts manufactured using a manufacturing device that is configured to form two parts in a single molding step.

Indeed, in one preferred version of this embodiment, depicted notably in FIGS. 1, 4, 5 and 6, the mold 15 and the imprint 18 have a shape which is such that they are able to manufacture a substantially crown-shaped intermediate part (depicted in section in FIG. 6) that has a longitudinal axis O-O and a plane of symmetry C orthogonal to the axis O-O. This intermediate part can be used, after cutting along the plane C, to form two parts 2A and 2B, as shown in FIG. 6. Each of these two parts 2A, 2B is identical to the part 2 shown in FIG. 2.

In the context of the disclosure herein, the mold 15 and the imprint 18 may have shapes and/or sizes that are appropriate for manufacturing parts of various sizes and/or shapes. In addition to annular parts, they may equally manufacture, for example, parts that are straight, parts that are curved, in particular in an arc of a circle, or parts of any shape.

Figure 7:
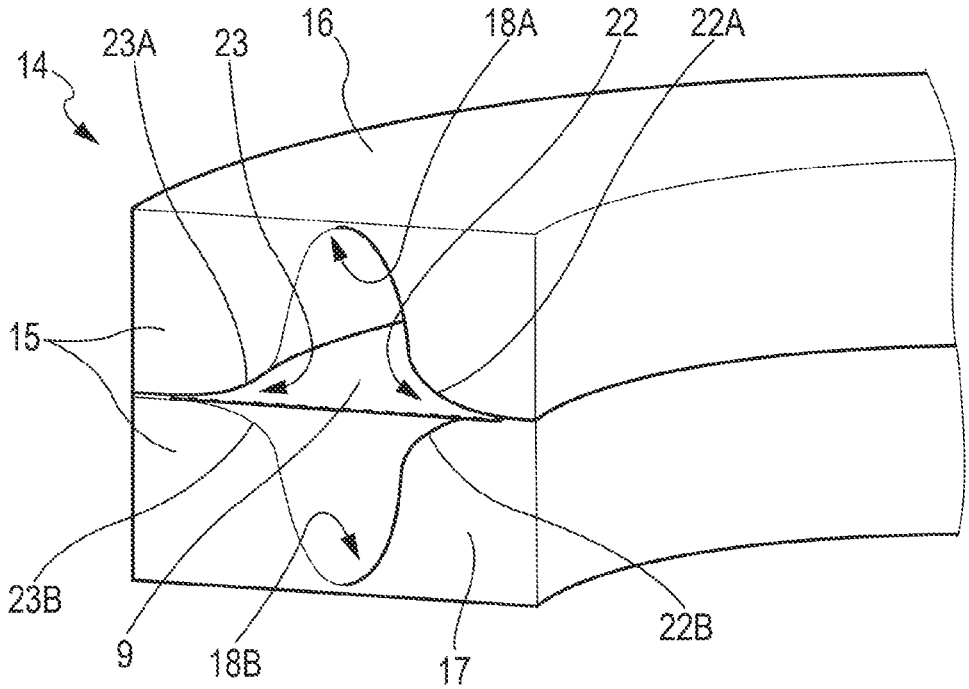
FIG. 7 is a partial perspective and cutaway view of an imprint comprising a first example of auxiliary spaces.
Figure 8:
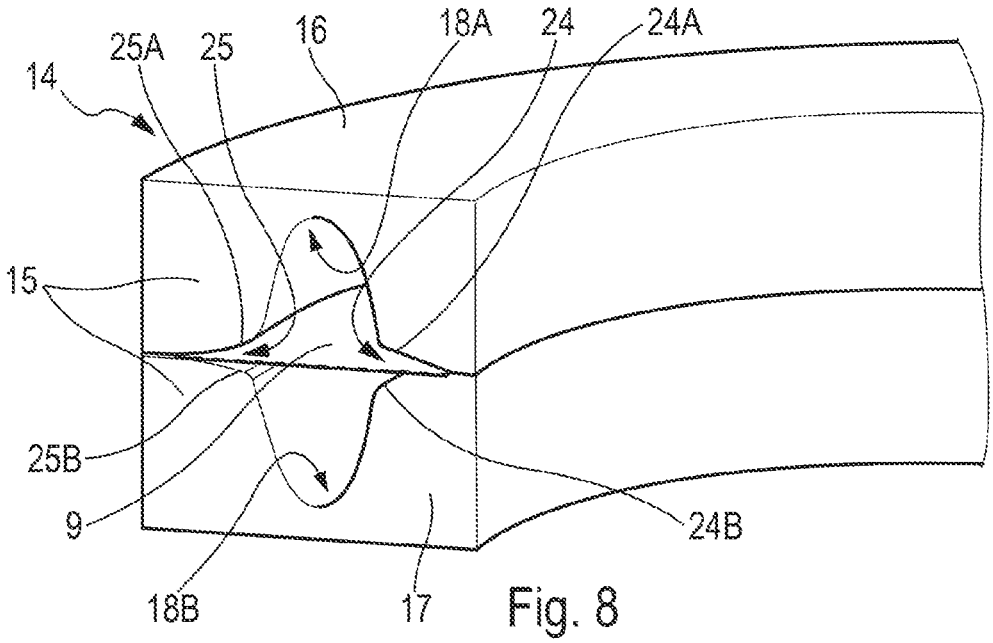
FIG. 8 is a partial perspective and cutaway view of an imprint comprising a second example of auxiliary spaces.

Moreover, in one particular embodiment, two examples of which are depicted in FIGS. 7 and 8, the imprint 18 comprises at least one auxiliary space 22, 23, 24, 25. This auxiliary space 22, 23, 24, 25 corresponds to an additional void created in the shells 16, 17, communicating with the imprint 18 but not necessarily serving to create the shape of the part 2 that is to be manufactured. Indeed, the auxiliary space 22, 23, 24, 25 is a functional space that serves to facilitate or supply the deformation of the cushion 9, as described hereinbelow.

In the context of the disclosure herein, the auxiliary space 22, 23, 24, 25 may take various shapes which depend on its function and on the shapes of the part 2 that is to be manufactured. The imprint 18 (comprising the partial imprints 18A and 18B) may comprise a single auxiliary space 22, 23, 24, 25 or several, each one being able to take a different shape.

In one particular embodiment, shown in FIG. 7, the imprint 18 comprises two auxiliary spaces 22 and 23. The auxiliary space 22 is located on the side of the imprint 18, oriented radially towards the axis X-X, and the auxiliary space 23 is located on the other side of the imprint 18, that is to say oriented radially in the direction away from the axis X-X.

By way of illustration, in the example of FIG. 7:

- the auxiliary space 22 which opens into the imprint 18 is bounded on one hand by a curved contour 22A of the shell 16 of the mold 15, formed between the inner end of the partial imprint 18A and the face 16A of the shell 16, and on the other hand by a curved contour 22B of the shell 17 of the mold 15, between the inner end of the partial imprint 18B and the face 17A of the shell 17; and
- the auxiliary space 23 which opens into the imprint 18 is bounded on one hand by a curved contour 23A of the shell 16 of the mold 15, formed between the inner end of the partial imprint 18A and the face 16A of the shell 16, and on the other hand by a curved contour 23B of the shell 17 of the mold 15, formed between the inner end of the partial imprint 18B and the face 17A of the shell 17.

The auxiliary space 22, 23 is configured to be able to contain some of the material of the cushion 9, the material contained in the auxiliary space 22, 23 being intended to supply the deformation of the cushion 9. Indeed, the cushion 9 may have, on its outer faces 10A and 11A, regions of increased thickness (not shown) that can be accommodated in the auxiliary spaces 22 and 23 when the cushion 9 is contained in the closed mold 15. These regions of increased thickness correspond to reserves of material and are intended to provide the material required for the walls of the cushion 9 to be able to perform adequately and completely match the shape of the imprint 18. In particular, this serves to avoid the walls of the cushion 9 tearing, or the appearance of excessively thin regions, in particular at the bottom of the imprint 18.

The auxiliary space 22, 23 may equally be configured to allow at least one end 9A, 9B of the cushion 9 to slide between the shells 16 and 17 of the mold 15 in order to supply material for the deformation of the cushion 9.

Indeed, as indicated above, the cushion 9 may have at least one of its ends 9A and 9B mounted so as to move freely relative to the mold 15. Furthermore, the shells 16 and 17 may be configured to squeeze the cushion 9 when the mold 15 is closed, but still allow at least one of the ends 9A and 9B to slide.

For example, in the embodiment depicted in FIGS. 1 and 4, the inner end 9A of the cushion 9 is free to move and the outer end 9B is fastened to the mold 15. Consequently, as the cushion 9 deforms (this being brought about by injection of pressurized fluid, as illustrated by the arrow F in FIG. 4), the end 9A is able to move in order to supply the deformation. More specifically, the deformation of the walls of the cushion 9, brought about by the injection of the pressurized fluid into the internal space 12, gives rise to forces on the ends 9A and 9B of the cushion 9, which draws the ends 9A and 9B towards the inside of the mold 15. Since the end 9B is fastened to the mold 15 it cannot move, but since the end 9A is mounted so as to be free it can be drawn towards the inside of the mold 15 during deformation of the cushion 9.

In this embodiment, the auxiliary space 22, 23 may be designed to facilitate the sliding of the end 9A towards the inside of the mold 15 during deformation of the cushion 9. To that end, the auxiliary space 22, 23 may in particular comprise fillets or more generally rounded shapes that help to avoid tearing of the cushion 9 as the end 9A slides.

By way of non-limiting example, a variant of the preceding embodiment is depicted in FIG. 8, in which the imprint 18 comprises two auxiliary spaces 24 and 25, having a different shape to the auxiliary spaces 22 and 23. The auxiliary space 24 is located on the side of the imprint 18, oriented radially towards the axis X-X, and the auxiliary space 25 is located on the other side of the imprint 18, that is to say oriented radially in the direction away from the axis X-X.

By way of illustration, in the example of FIG. 8:

- the auxiliary space 24 which opens into the imprint 18 is bounded on one hand by a straight contour 24A of the shell 16 of the mold 15, forming a bevel between the inner end of the partial imprint 18A and the face 16A of the shell 16, and on the other hand by a straight contour 24B of the shell 17 of the mold 15, forming a bevel between the inner end of the partial imprint 18B and the face 17A of the shell 17; and
- the auxiliary space 25 which opens into the imprint 18 is bounded on one hand by a straight contour 25A of the shell 16 of the mold 15, forming a bevel between the inner end of the partial imprint 18A and the face 16A of the shell 16, and on the other hand by a straight contour 25B of the shell 17 of the mold 15, forming a bevel between the inner end of the partial imprint 18B and the face 17A of the shell 17.

In the context of the disclosure herein, the manufacture implemented by the device 1 as described hereinabove may be carried out cold. The device 1 is then used at ambient temperature.

In the context of the disclosure herein, the manufacture implemented by the device 1 as may also be carried out hot. To that end, in one particular embodiment, the device 1 also comprises an oven 34, which is depicted schematically in FIG. 4. This oven 34 is able to receive at least the mold 15 containing the cushion 9, and it is designed to produce a predetermined temperature, for example between 500° C. and 950° C. This particular embodiment therefore makes it possible to carry out manufacture of the part 2, by heating the cushion 9 prior to and during its deformation.

In a first variant of this particular embodiment, only the cushion 9 is positioned in the oven, the mold 15 being left at ambient temperature. This first variant embodiment therefore makes it possible to manufacture the part 2, by heating only the cushion 9 before it is positioned and deformed in the mold 15.

In a second variant embodiment, the molding unit 14 may comprise a mold 15 which is a mold of the heating type, and may be designed to directly heat the cushion 9. This second variant embodiment therefore makes it possible to carry out hot manufacturing without using an oven.

The device 1, as described hereinabove, is able to implement a method P for manufacturing a part made of deformable material, for example such as the part depicted in FIG. 2.

Figure 9:
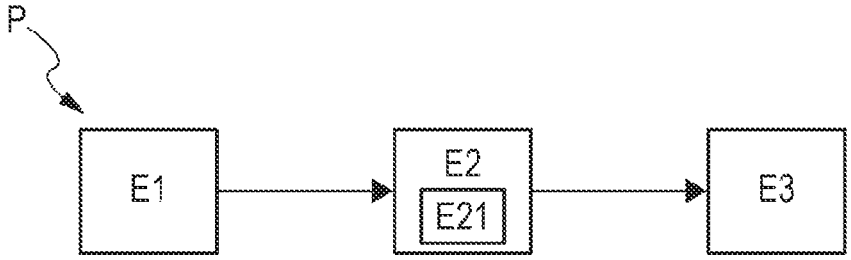
FIG. 9 is a synoptic diagram of a manufacturing method.

To that end, the method P comprises, as shown in FIG. 9, the following steps:

- a preparation step E1 that consists in or comprises creating a cushion 9 provided with two plates 10, 11 arranged against one another so as to create an internal space 12 and comprising at least one opening 13 that allows access to this internal space 12;
- a molding step E2 that is carried out by the molding unit 14 and consists in or comprises positioning the cushion 9 (created during the preparation step E1) at least partially in the mold 15 which comprises at least two shells 16 and 17 and an imprint 18 corresponding to the shape of the part 2 that is to be manufactured, closing the mold 15 by joining the shells 16 and 17 to one another, and injecting a pressurized fluid into the internal space 12 of the cushion 9 through the opening 13 so as to deform the cushion 9 in order that it matches the imprint 18 of the mold 15 and forms a rough part that has the shape of the part 2 that is to be manufactured; and
- a finishing step E3 that consists in or comprises demolding the rough part obtained at the end of the molding step E2, and carrying out finishing operations on the rough part in order to obtain the manufactured part 2.

The finishing step E3 consists in or comprises carrying out finishing operations on the rough part, in particular cutting off excess material, in order to obtain the part 2.

In one particular embodiment, the rough part may equally be cut so as to obtain at least two identical parts 2 (part 2A and 2B in FIG. 6).

The end of the finishing step E3 yields the part(s) 2 manufactured by the method P.

In addition, the manufacture implemented by the method P can be carried out cold or hot.

When the manufacturer is carried out hot, the molding step E2 comprises a heating sub-step E21 which is implemented prior to injecting the pressurized fluid into the cushion 9, and which consists in or comprises heating at least the cushion 9. This step E21 therefore consists in or comprises heating the cushion 9 at least prior to deforming it.

In a first embodiment, the heating sub-step E21 consists in or comprises integrating the molding unit 14 into the oven 34, as depicted schematically in FIG. 4, and in carrying out at least the deformation of the cushion 9 while hot, that is to say at the temperature generated by the oven 34, for example between 500° C. and 950° C.

In a variant of this first embodiment, the heating sub-step E21 consists in or comprises heating only the cushion 9, the mold 15 being left at ambient temperature. In this variant embodiment, the cushion 9 is first placed in the oven, where it is heated, then the cushion 9 thus heated is removed from the oven and is placed in the mold 15 in order to be deformed.

In a second embodiment, the heating sub-step E21 consists in or comprises heating the cushion 9 using a mold 15 which is a mold of the heating type.

The device 1 and the method P, as described hereinabove, which serve for manufacturing one-piece parts by displacement and deformation of material, have numerous advantages.

In particular, by virtue of the preparation of the cushion 9 (comprising an internal space 12) which undergoes deformation in the mold 15 by injection of a pressurized fluid into the internal space 12 of the cushion 9, the device 1 and the method P make it possible to manufacture parts 2 having various shapes and/or sizes, in particular annular parts, straight parts or curved parts, in particular in the shape of an arc of a circle.

In particular, they make it possible to manufacture one-piece parts having complex shapes, in particular parts whose shape is non-developable. To that end, it is necessary to provide suitable shapes for the imprint 18 and the cushion 9.

The device 1 and the method P may be used to manufacture parts made of different materials, in particular metallic materials, and in particular made of titanium alloy or aluminum alloy.

Furthermore, the design of the mold 15 makes it possible to have a device 1 which is relatively simple and flexible to implement since the molding unit 14 does not necessarily require heavy tooling such as a press.

Furthermore, in one preferred embodiment, using a suitably shaped mold, the device 1 makes it possible to simultaneously manufacture, in a single execution of the method P, two parts 2 such as those depicted in FIG. 6.

While at least one example embodiment of the invention(s) is disclosed herein, it should be understood that modifications, substitutions and alternatives may be apparent to one of ordinary skill in the art and can be made without departing from the scope of this disclosure. This disclosure is intended to cover any adaptations or variations of the example embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A method for manufacturing at least one part made of deformable material for an edge of an element, the method comprising:

a preparation step comprising creating a cushion comprising two plates arranged against one another to create an internal space and comprising at least one opening that allows access to the internal space;

a molding step comprising:

positioning the cushion at least partially in a mold, the mold comprising at least two shells, at least one of the at least two shells defining an imprint corresponding to a shape of the part that is to be manufactured and at least one auxiliary space formed between the imprint and a face of the at least one of the at least two shells, the at least one auxiliary space configured to receive a portion of material of the cushion, wherein the portion of material of the cushion in the at least one auxiliary space comprises a region of increased thickness relative to other portions of the cushion;

closing the mold by joining the shells to one another; and injecting a pressurized fluid into the internal space of the cushion through the opening to deform the cushion to match the imprint of the mold and form a rough part that has a shape of the part that is to be manufactured, wherein the portion of material of the cushion in the at least one auxiliary space extends toward the imprint as the cushion deforms; and a finishing step comprising demolding the rough part and carrying out finishing operations on the rough part to obtain the manufactured part.

2. The method of claim 1, wherein the molding step further comprises a heating sub-step after the mold has been closed and which comprises heating at least the cushion prior to injection of the pressurized fluid.

3. The method of claim 2, wherein the heating sub-step corresponds to one of sub-steps of:

placing the mold containing the cushion in an oven and heating the mold and the cushion using the oven;

placing the cushion alone in an oven and heating the cushion prior to placing it in the mold;

heating the cushion using the mold, the mold being of a heating type.

4. The method of claim 1, wherein, in the preparation step, the plates of the cushion are arranged by securing the plates to one another by welding at their peripheral ends.

5. The method of claim 1, wherein, in the molding step, the cushion is positioned in the mold whose imprint corresponds to a shape by which it is possible to simultaneously manufacture at least two parts.

6. The method of claim 1, wherein the cushion is annular in shape, comprising an inner end corresponding to an inner periphery of the annular shape, and an outer end corresponding to an outer periphery of the annular shape, and wherein, in the molding step, at least one of the inner and outer ends of the cushion is fastened to the mold.

7. The method of claim 1, wherein the cushion is annular in shape, comprising an inner end corresponding to an inner periphery of the annular shape, and an outer end corresponding to an outer periphery of the annular shape, and wherein, in the molding step, the inner and outer ends of the cushion are mounted to move freely relative to the mold.

8. The method of claim 1, wherein the at least one auxiliary space comprises one or more bevels, fillets, or rounded shapes configured to facilitate sliding of the portion of material of the cushion relative to the mold as the cushion deforms.

* * * * *